US007309551B2

(12) United States Patent
Tong et al.

(10) Patent No.: US 7,309,551 B2
(45) Date of Patent: Dec. 18, 2007

(54) ELECTRON CONDUCTIVE OVERCOAT LAYER FOR PHOTORECEPTORS

(75) Inventors: Yuhua Tong, Webster, NY (US); John F. Yanus, Webster, NY (US); Anthony M. Horgan, Pittsford, NY (US); T. Edwin Freeman, Webster, NY (US); Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 413 days.

(21) Appl. No.: 11/073,548

(22) Filed: Mar. 8, 2005

(65) Prior Publication Data

US 2006/0204873 A1 Sep. 14, 2006

(51) Int. Cl.
*G03G 5/147* (2006.01)

(52) U.S. Cl. ..... 430/66; 430/132

(58) Field of Classification Search ..... 430/66, 430/132

See application file for complete search history.

(56) References Cited

U.S. PATENT DOCUMENTS

| | | | | |
|---|---|---|---|---|
| 3,121,006 | A | 2/1964 | Middleton et al. | |
| 3,357,989 | A | 12/1967 | Byrne et al. | |
| 3,442,781 | A | 5/1969 | Winberger | |
| 4,081,274 | A | 3/1978 | Horgan | |
| 4,115,116 | A | 9/1978 | Stolka et al. | |
| 4,233,384 | A | 11/1980 | Turner et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,299,897 | A | 11/1981 | Stolka et al. | |
| 4,304,829 | A | 12/1981 | Limburg et al. | |
| 4,306,008 | A | 12/1981 | Pai et al. | |
| 4,338,387 | A | 7/1982 | Hewitt | |
| 4,415,639 | A | 11/1983 | Horgan | |
| 4,439,509 | A | 3/1984 | Schank | |
| 4,647,521 | A | 3/1987 | Oguchi et al. | |
| 4,664,995 | A | 5/1987 | Horgan et al. | |
| 4,675,262 | A | 6/1987 | Tanaka | |
| 4,678,731 | A | 7/1987 | Yoshizawa et al. | |
| 4,713,308 | A | 12/1987 | Yoshizawa et al. | |
| 4,717,637 | A | 1/1988 | Yoshizawa et al. | |
| 4,784,928 | A | 11/1988 | Kan et al. | |
| 4,855,203 | A | 8/1989 | Badesha et al. | |
| 4,869,982 | A | 9/1989 | Murphy | |
| 5,008,167 | A | 4/1991 | Yu | |
| 5,096,795 | A | 3/1992 | Yu | |
| 5,521,047 | A | 5/1996 | Yuh et al. | |
| 5,561,021 | A * | 10/1996 | Yamazaki et al. | 430/130 |
| 5,707,767 | A | 1/1998 | Yu | |
| 5,709,974 | A | 1/1998 | Yuh et al. | |
| 5,891,594 | A | 4/1999 | Yuh et al. | |
| 6,132,913 | A | 10/2000 | Fuller et al. | |
| 6,214,514 | B1 | 4/2001 | Evans et al. | |
| 2004/0086794 | A1 | 5/2004 | Yamada et al. | |
| 2006/0029872 | A1 * | 2/2006 | Qi et al. | 430/58.8 |

* cited by examiner

*Primary Examiner*—John L Goodrow
(74) *Attorney, Agent, or Firm*—Oliff & Berridge, PLC

(57) ABSTRACT

An imaging member includes a substrate, a charge generating layer, a charge transport layer, and an outer overcoat layer including an electron conductive material.

18 Claims, No Drawings

ELECTRON CONDUCTIVE OVERCOAT LAYER FOR PHOTORECEPTORS

BACKGROUND

The present disclosure relates to improved photoreceptor designs for electrostatographic printing devices, particularly photoreceptors having electron conductive overcoat layers, thereby providing extended wear and improved operation. More particularly, the present disclosure relates to photoreceptors having electron conductive overcoat layers that include a mixture of metal alkoxide and an amine in a polymeric matrix.

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. Current layered organic imaging members generally have at least a substrate layer and two active layers. These active layers generally include (1) a charge generating layer containing a light-absorbing material, and (2) a charge transport layer containing electron donor molecules. These layers can be in any order, and sometimes can be combined in a single or mixed layer. The substrate layer may be formed from a conductive material. In addition, a conductive layer can be formed on a nonconductive substrate.

The charge generating layer is capable of photogenerating charge and injecting the photogenerated charge into the charge transport layer. For example, U.S. Pat. No. 4,855,203 to Miyaka teaches charge generating layers comprising a resin dispersed pigment. Suitable pigments include photoconductive zinc oxide or cadmium sulfide and organic pigments such as phthalocyanine type pigment, a polycyclic quinone type pigment, a perylene pigment, an azo type pigment and a quinacridone type pigment. Imaging members with perylene charge generating pigments, particularly benzimidazole perylene, show superior performance with extended life.

In the charge transport layer, the electron donor molecules may be in a polymer binder. In this case, the electron donor molecules provide hole or charge transport properties, while the electrically inactive polymer binder provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating layer and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

As more advanced, higher speed electrophotographic copiers, duplicators and printers have been developed, and as the use of such devices increases in both the home and business environments, degradation of image quality has been encountered during extended cycling. Moreover, complex, highly sophisticated duplicating and printing systems operating at very high speeds have placed stringent requirements upon component parts, including such constraints as narrow operating limits on the photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed for use as a belt or as a roller in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl back coating and an optional overcoating layer.

Imaging members are generally exposed to repetitive electrophotographic cycling, which subjects the exposed charge transport layer thereof to abrasion, chemical attack, heat and multiple exposures to light. This repetitive cycling leads to a gradual deterioration in the mechanical and electrical characteristics of the exposed charge transport layer. For example, the uppermost charge transport layer in many imaging member designs has inadequate wear resistance under some machine conditions, which wear is exacerbated by charging and machine components. Further, the hole transport materials can be oxidized contaminated by outside agents, like ozone, nitric acid, morpholine, and other reactive chemicals, which leads to various imaging and electrical problems. Finally, the repeated cycling of the imaging members can cause small molecule crystallization and polymer cracking, also resulting in imaging problems. Attempts have been made to overcome these problems. However, the solution of one problem often leads to additional problems.

One solution that has been attempted is to provide a thin overcoat layer over the charge transport layer. Various types of overcoat layer, which are scribed in the patent literature, include hydrolyzed siloxane gel overcoats, silicon overcoats, and polyamide overcoats. For example, exemplary hydrolyzed siloxane gel materials are disclosed in U.S. Pat. No. 4,439,509, and exemplary polyamide overcoat materials are disclosed in U.S. Pat. No. 6,132,913.

The use of silicon-containing compounds in photoreceptor layers, including in photosensitive and protective layers, has been shown to increase the mechanical lifetime of electrophotographic photoreceptors, under charging conditions and scorotron charging conditions. For example, U.S. Patent Application Publication US 2004/0086794 to Yamada et al., which is incorporated herein by reference in its entirety, discloses a photoreceptor having improved mechanical strength and stain resistance.

U.S. Pat. Nos. 5,096,795 and 5,008,167 disclose electrophotographic imaging devices, where the exposed layer has particles, such as metal oxide particles, homogeneously dispersed therein. The particles provide coefficient of surface contact friction reduction, increased wear resistance, durability against tensile cracking, and improved adhesion of the layers without adversely affecting the optical and electrical properties of the imaging member.

U.S. Pat. No. 4,784,928 discloses an electrophotographic element having two charge transport layers. An outermost charge transport layer or overcoating may comprise a waxy spreadable solid, stearates, polyolefin waxes, and fluorocarbon polymers such as Vydax fluorotelomer from du Pont and Polymist F5A from Allied Chemical Company.

U.S. Pat. No. 4,717,637 discloses a microcrystalline silicon barrier layer.

U.S. Pat. Nos. 4,678,731 and 4,713,308 disclose microcrystalline silicon in the photoconductive and barrier layers of a photosensitive member.

U.S. Pat. No. 4,647,521 discloses the addition of amorphous hydrophobic silica powder to the top layer of a photosensitive member. The silica is of spherical shape and has a size distribution between 10 and 1000 Angstroms. Hydrophobic silica is a synthetic silica having surface silanol (SiOH) groups replaced by hydrophobic organic groups such as $—CH_3$.

However, for all of the above overcoat variations, compatibility of the overcoat materials and adhesion of the overcoat materials with the underlying charge transport layer are important issues. Also, the effect of the overcoat layer on the electrical properties of the entire imaging member in another important issue. As to the overcoat materials themselves, an important factor is the pot-life of the coating solution. Generally, practical application of an overcoat layer requires trade-offs between good electrical properties of the charge transport layer and improved mechanical properties. As a result, most of the current overcoat layer designs provide thin layers (less than about 5 microns). The thin layers provide mechanical benefits while not unduly deteriorating the electrical properties. The thin layers also keep manufacturing cost down, due to a generally high cost of the overcoat materials.

SUMMARY

Despite the various known photoreceptor designs, there is a continued need in the art for improved photoreceptor packages. For example, there remains a need in the art for longer-lasting photoreceptors while providing lower operating costs. In particular, there is a need in the art for lower operating cost electrostatographic printing devices, where lower costs are derived from improved photoreceptor designs. Such improved photoreceptor designs should include increased wear resistance, i.e., low photoreceptor wear, while still providing improved toner transfer, improved cleaning properties, lower toner adhesion, and the like.

The present disclosure addresses these and other needs by providing a photoreceptor having improved wear and scratch resistance. These benefits are provided by including in the photoreceptor design an electron conductive overcoat layer.

In particular, the present disclosure provides an imaging member comprising:

a substrate, a charge generating layer, a charge transport layer, and an external overcoating layer comprising an electron conductive material.

The present disclosure also provides a method for making such an imaging member, generally comprising:

providing an imaging member substrate, and applying at least a charge generating layer and a charge transport layer to said substrate, and applying an electron conductive overcoating layer over said charge generating layer and a charge transport layer, wherein said external overcoating layer comprises an electron conductive material.

DETAILED DESCRIPTION OF PREFERRED EMBODIMENTS

The present disclosure relates to imaging members having improved wear and scratch resistance, and to methods of forming such imaging members.

According to embodiments of the present disclosure, an electrophotographic imaging member is provided, which generally comprises at least a substrate layer, a charge generating layer, a charge transport layer, and an electron conductive overcoating layer. The charge generating layer and the charge transport layer can, in embodiments, be combined in a single layer. This imaging member can be employed in an imaging process comprising providing the electrophotographic imaging member, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps. These imaging members may be fabricated by any of the various known methods.

In general, electrostatographic imaging members are well known in the art. An electrostatographic imaging member, including the electrostatographic imaging member of the present disclosure, may be prepared by any of the various suitable techniques, provided that an electron conductive overcoat layer is applied as an external overcoat layer as described below. Suitable conventional photoreceptor designs that can be modified in accordance with the present disclosure include, but are not limited to, those described for example in U.S. Pat. Nos. 4,647,521, 4,664,995, 4,675,262, 4,678,731, 4,713,308, 4,717,637, 4,784,928, 4,869,982, 5,008,167, 5,096,795, and 5,707,767, the entire disclosures of which are incorporated herein by reference.

According to the present disclosure, the external (overcoat) layer includes an electron conductive material, such as a reaction product of a metal alkoxide and an amine, in a polymeric binder matrix. Typically, a flexible or rigid substrate is provided having an electrically conductive surface. A charge generating layer is then usually applied to the electrically conductive surface. An optional charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer may be applied prior to the charge generation layer.

In the overcoat layer of embodiments, any suitable metal alkoxide and amine can be used, to provide the electron conductive layer. Suitable metal alkoxides and amines include, but are not limited to, transition metal alkoxides and aliphatic amines.

Although not limited to any particular materials, the metal alkoxides of embodiments can include any suitable metal, including but not limited to transition metals such as zirconium, titanium, zinc, hafnium, vandium and the like, mixtures thereof, and the like. Specific examples of suitable metal alkoxides thus include, but are not limited to, zirconium isopropoxide, titanium (IV) isopropoxide, titanium (IV) methoxide, diisopropoxybisethylacetoacetato titanate, triethanolamine titanate, triethanolamine zirconate, titanium butoxide, titanium diisopropoxide bis(acetylacetonate), titanium diisopropoxide bis(2,2,6,6-tetramethyl-3,5-heptanedionate), titanium(IV) ethoxide, titanium(IV) 2-ethyl-1,3-hexanediolate, titanium(IV) 2-ethylhexoxide, zirconium(IV) tert-butoxide, zirconium(IV) acetylacetonate, zirconium(IV) acetate hydroxide, zirconium(IV) bis(diethyl citrate)dipropoxide, and mixtures thereof, and the like.

Preferably, in embodiments, the metal alkoxide is titanium isopropoxide, particularly titanium (IV) isopropoxide.

The metal alkoxide is mixed with an amine in the overcoat layer, where the metal alkoxide and amine react to form a reaction product. Suitable amines include, but are not limited to, 3-aminopropyltriethoxysilane, Ethanolamine, 3-amino-1,2-propanediol, 3-aminopropyltrimethoxysilane, triethanolamine, Jeffamines (from Huntsman Company), N.N-dimethylaminoethyl methacrylate, mixtures thereof, and the like.

The electron conducting material is dispersed in a polymeric binder material to form the overcoat layer. Typical suitable overcoat layer polymeric binders include, but are not limited to, polyvinylbutyral, poly(vinyl carbazole), organosilanes, epoxy resins, polyesters, polyamides, polyurethanes, pyroxyline vinylidene chloride resin, silicone resins, fluorocarbon resins, polycarbonates, polyacrylates and methacrylates, copolymers of vinyl chloride and vinyl acetate, phenoxy resins, poly(vinyl alcohol), polyacrylonitrile, polystyrene, poly(vinylbenzyl alcohol) and the like.

In embodiments of the present disclosure, the electron conductive material is preferably included in the overcoat layer in an amount of from about 5 to about 95 percent by weight of the layer. Preferably, the electron conductive material is included in an amount of from about 15 to about 85 percent, and more preferably from about 35 to about 75 percent, by weight of the overcoat layer.

The particular construction of an exemplary imaging member will now be described in more detail. However, the following discussion is of only one embodiment, and is not limiting of the disclosure.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including, but not limited to, polyesters, polycarbonates, polyamides, polyurethanes, mixtures thereof, and the like. As electrically conductive materials there may be employed various resins that incorporate conductive particles, including, but not limited to, resins containing an effective amount of carbon black, or metals such as copper, aluminum, nickel, and the like. The substrate can be of either a single layer design, or a multi-layer design including, for example, an electrically insulating layer having an electrically conductive layer applied thereon.

The electrically insulating or conductive substrate is preferably in the form of a rigid cylinder, drum or belt. In the case of the substrate being in the form of a belt, the belt can be seamed or seamless, with a seamless belt being particularly preferred.

The thickness of the substrate layer depends on numerous factors, including strength and rigidity desired and economical considerations. Thus, this layer may be of substantial thickness, for example, about 5000 micrometers or more, or of minimum thickness of less than or equal to about 150 micrometers, or anywhere in between, provided there are no adverse effects on the final electrostatographic device. The surface of the substrate layer is preferably cleaned prior to coating to promote greater adhesion of the deposited coating. Cleaning may be effected by any known process including, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate, e.g. a polyester web substrate such as Mylar available from E. I. du Pont de Nemours & Co., with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may optionally be applied thereto for photoreceptors. Generally, electron blocking layers for positively charged photoreceptors allow holes from the imaging surface of the photoreceptor to migrate toward the conductive layer. For negatively charged photoreceptors, the blocking layer allows electrons to migrate toward the conducting layer. Any suitable blocking layer capable of forming an electronic barrier to holes between the adjacent photoconductive layer and the underlying conductive layer may be utilized. The blocking layer may include film forming polymers, such as nylon, epoxy and phenolic resins. The polymeric blocking layer may also contain metal oxide particles, such as titanium dioxide or zinc oxide. The blocking layer may also include, but is not limited to, nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl)methyl diethoxysilane, $[H_2N(CH_2)_3]CH_3Si(OCH_3)_2$ (gamma-aminopropyl) methyl diethoxysilane, mixtures thereof, and the like, as disclosed in U.S. Pat. Nos. 4,291,110, 4,338,387, and 4,286,033, the entire disclosures of which are incorporated herein by reference. A preferred blocking layer comprises a reaction product between a hydrolyzed silane and the oxidized surface of a metal ground plane layer. The oxidized surface inherently forms on the outer surface of most metal ground plane layers when exposed to air after deposition.

The blocking layer can be further doped with fillers, such as metal oxides, to improve its functionality. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like.

The blocking layers should be continuous and have a thickness of less than about 15 micrometer because greater thicknesses may lead to undesirably high residual voltage.

An optional adhesive layer may be applied to the hole blocking layer. Any suitable adhesive layer well known in the art may be utilized. Typical adhesive layer materials include, for example, but are not limited to, polyesters, dupont 49,000 (available from E. I. dupont de Nemours and Company), Vitel PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive or blocking layer, which in turn can then be overcoated with a contiguous hole (charge) transport layer as described hereinafter. Examples of typical photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material may be employed as the matrix in the photogenerating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, mixtures thereof, and the like. These polymers may be block, random or alternating copolymers.

The photogenerating composition or pigment may be present in the resinous binder composition in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. Thickness outside these ranges can be selected providing the objectives of the present disclosure are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The electrophotographic imaging member of the present disclosure generally contains a charge transport layer in addition to the charge generating layer. The charge transport layer comprises any suitable organic polymer or non-polymeric material capable of transporting charge to selectively discharge the surface charge. Charge transporting layers may be formed by any conventional materials and methods, such as the materials and methods disclosed in U.S. Pat. No. 5,521,047 to Yuh et al., the entire disclosure of which is incorporated herein by reference. In addition, the charge transporting layers may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

The charge transport layer of the disclosure generally include at least a binder and at least one arylamine charge transport material. The binder should eliminate or minimize crystallization of the charge transport material and should be soluble in a solvent selected for use with the composition such as, for example, methylene chloride, chlorobenzene, tetrahydrofuran, toluene or another suitable solvent. Suitable binders may include, for example, polycarbonates, polyesters, polyarylates, polyacrylates, polyethers, polysulfones and mixtures thereof. For the preferred solvent of methylene chloride and the preferred charge transport materials, the binder is preferably a polycarbonate. Although any polycarbonate binder may be used, preferably the polycarbonate is either a bisphenol Z polycarbonate or a biphenyl A polycarbonate. Example biphenyl A polycarbonates are the MAKROLON® polycarbonates. Example bisphenol Z polycarbonates are the LUPILON® polycarbonates, also widely identified in the art as PCZ polycarbonates, e.g., PCZ-800, PCZ-500 and PCZ-400 polycarbonate resins and mixtures thereof.

As the charge transport materials, at least one of the charge transport materials preferably comprise an arylamine compound, although others can be used. Arylamine charge transport materials can be subdivided into monoamines, diamines, triamines, etc. Examples of aryl monoamines include: bis-(4-methylphenyl)-4-biphenylylamine, bis(4-methoxyphenyl)-4-biphenylylamine, bis-(3-methylphenyl)-4-biphenylylamine, bis(3-methoxyphenyl)-4-biphenylylamine-N-phenyl-N-(4-biphenylyl)-p-toluidine, N-phenyl-N-(4-biphenylyl)-p-toluidine, N-phenyl-N-(4-biphenylyl)-m-anisidine, bis(3-phenyl)-4-biphenylylamine, N,N,N-tri[3-methylphenyl]amine, N,N,N-tri[4-methylphenyl]amine, N,N-di(3-methylphenyl)-p-toluidine, N,N-di(4-methylphenyl)-m-toluidine, bis-N,N-[(4'-methyl-4-(1,1'-biphenyl)]-aniline, bis-N,N-[(2'-methyl-4(1,1'-biphenyl)]-aniline, bis-N,N-[(2'-methyl-4(1,1'-biphenyl)]-p-toluidine, bis-N,N-[(2'-methyl-4(1,1'-biphenyl)]-m-toluidine, and N,N-di-(3,4-dimethylphenyl)-4-biphenylamine (DBA), and mixtures thereof. Examples of aryl diamines include: those described in U.S. Pat. Nos. 4,306,008, 4,304,829, 4,233,384, 4,115,116, 4,299,897, 4,265,990, 4,081,274 and 6,214,514, each incorporated herein by reference. Typical aryl diamine transport compounds include N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3-methylphenyl)-[1,1'-biphenyl]-4,4'-diamine, N,N'-diphenyl-N,N'-bis(3-hydroxyphenyl)-(1,1'-biphenyl)-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, mixtures thereof and the like.

Typically, the charge transport material is present in the charge transport layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges. Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra-red radiation drying, air drying and the like.

Generally, the thickness of the charge transport layer is between about 10 and about 50 micrometers, but thicknesses outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

An overcoat layer, particularly an electron conductive overcoat layer as described above, is applied over the charge transport layer.

The thickness of the continuous overcoat layer selected may depend upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred, in embodiments. However, because the overcoating layer is electron conductive, thicker overcoating layers can be employed in other embodiments. In these embodiments, the thickness can be between about 0.01 micrometer and about 20 micrometers in thickness.

Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this disclosure should transport electrons during imaging and should not have too high a free carrier concentration. Free carrier concentration in the overcoat increases the dark decay. Preferably the dark decay of the overcoated layer should be the same as that of the unovercoated device.

Other layers may also be used, such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases, an anti-curl back coating may be applied to the side opposite the photoreceptor to provide flatness and/or abrasion resistance. These anti-curl back coating layers are well known in the art and may comprise thermoplastic organic polymers or inorganic polymers that are electrically insulating or slightly semiconductive.

Any suitable conventional electrophotographic charging, exposure, development, transfer, fixing and cleaning techniques may be utilize to form and develop electrostatic latent images on the imaging member of this disclosure. Thus, for example, conventional light lens or laser exposure systems may be used to form the electrostatic latent image. The resulting electrostatic latent image may be developed by suitable conventional development techniques such as magnetic brush, cascade, powder cloud, and the like.

While the disclosure has been described in conjunction with the specific embodiments described above, it is evident that many alternatives, modifications and variations are apparent to those skilled in the art. Accordingly, the preferred embodiments of the disclosure as set forth above are intended to be illustrative and not limiting. Various changes can be made without departing from the spirit and scope of the disclosure.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

Preparation of Coating Solution

A coating solution is prepared from titanium (IV) isopropoxide (98+% purity), polyvinyl vutyral resin, and 3-aminoproyltrimethoxysilane (97% purity), all available from Fisher Scientific, Inc. The solution is made by adding 4.0 grams titanium (IV) isopropoxide to 4.0 grams 3-aminoproyltrimethoxysilane with slight stirring. An exothermic reaction instantly occurs, to give a clear solution. The solution is added to a polymer solution of 1.5 grams polyvinyl vutyral resin and 40.0 grams 1-propanol, which at the beginning forms an opaque solution. The mixture is stirred slightly to provide a clear solution after several hours. The resultant solution is ready for coating as an electron conductive overcoat layer.

Example 2

Preparation of a Drum Coated Photoreceptor

An electrophotographic imaging member is prepared. The imaging member includes a 30 mm diameter honed aluminum substrate, a blocking or undercoating layer, a charge generating layer, and a charge transport layer. The blocking layer is coated using a solution of Luckamide (a polyamide film forming polymer available from Dai Nippon Ink) in a mixture of methanol, butanol and water, at 55, 36 and 9 parts by weight. The blocking layer is applied at a thickness of 1.0 micrometer, and is dried at 145° C. for 15 minutes. The charge generating layer is coated using a solution of 9.6 parts by weight chlorogallium phthalocyanine (ClGaPC) in 14.4 parts by weight VMCH (available from Union Carbide) in 76 parts by weight of solvent mixture, consisting of 50:50 by weight butyl alcohol:xylene The charge generating layer is air dried at room temperature. The dried charge generator layer thickness is about 0.2 micrometer.

A charge transporting layer is coated using a solution of a mixture of 60 weight % of PCZ-400 (a polycarbonate), and 40 weight % of charge transport molecule (N,N'-diphenyl-N,N'-bis(3-methylpropyl)-(1,1'-biphenyl)-4,4'-diamine). The solution is in 70:30 by weight ratio of tetrahydrofuran: toluene solvent mixture, providing an approximate solids content of 33% by weight. The charge transporting layer is dried at 135° C. for 45 minutes. The dried charge transporting layer thickness is about 25 microns.

Example 3

Preparation of a Drum Coated Photoreceptor With Overcoating Layer

An overcoating layer is coated over the dried charge transporting layer. The overcoating layer is coated using the solution of Example 1, by a Tsukiage dip coating process. The overcoating layer is dried at 145° C. for 15 minutes. The dried overcoating layer thickness is about 1.0 micron.

Comparative Example 1

For comparison, a reference imaging device is prepared in the manner of Example 2.

Following completion of the imaging member, the coating appearance of the imaging member is observed to be clear with a very uniform appearance. The PIDC and Q-V curves for the imaging member and the control imaging member are also obtained and measured.

The electrical properties of the prepared photoreceptor devices are tested in accordance with standard drum photoreceptor test methods. The electrical properties of the photoreceptor samples are evaluated with a xerographic testing scanner. The drums are rotated at a constant surface speed of 15.7 cm per second. A direct current wire scorotron, narrow wavelength band exposure light, erase light, and four electrometer probes are mounted around the periphery of the mounted photoreceptor samples. The sample charging time is 177 milliseconds. The exposure light has an output wavelength of 680 nanometers (nm) and the erase light has an output wavelength of 550 nm.

The test sample is first rested in the dark for at least 60 minutes to ensure achievement of equilibrium with the testing conditions at 50 percent relative humidity and 72° F. The sample is then negatively charged in the dark to a potential of about 500 volts. The test procedure is repeated to determine the photo induced discharge characteristic (PIDC) of the sample by different light energies of up to 40 ergs/cm$^2$.

The electrical properties are shown in Table 1.

TABLE 1

| Sample | V(0) (volt) | V(2.6) (volt) | V(4.26) (volt) | V(13) (volt) | Dv/dx (volt * cm$^2$/ erg.) | Verase (volt) | Dark decay (volt) | Q/A PIDC (nC/cm^2) |
|---|---|---|---|---|---|---|---|---|
| Example 3 | 486 | 133 | 51 | 27 | −177 | 20 | 13 | 63 |
| Comparative Example 1 | 496 | 169 | 100 | 59 | −179 | 43 | 8 | 56 |

With reference to the abbreviations employed in Table 1:
V(0) (PIDC) is the dark voltage after scorotron charging
Q/A PIDC is the current density to charge the devices to the V(0) values
Dark Decay is 0.2 s Duration Decay voltage
V(2.6) is average voltage after exposure to 2.6 erg/cm$^2$
V(4.26) is average voltage after exposure to 4.26 erg/cm$^2$
V(13) is average voltage after exposure to 13 erg/cm$^2$
dV/dX is the initial slope of the PIDC
Verase is average voltage after erase exposure The example in accordance with the present disclosure exhibited excellent charging characteristics with low residual potential and low dark decay.

Comparison of the PIDC and Q-V curves for the imaging member and the control imaging member show no significant differences. Print tests conducted using the two imaging members also show comparable high image print quality, although the print quality of the control imaging member is slightly better.

The imaging member and control imaging member are also tested for wear in a bench wear fixture with a BCR roll (available from Hodaka) and toners. The overcoated imaging member shows exceptional wear stability, with more uniform wear on the photoreceptor as compared to the control imaging member without the overcoating layer.

Example 4

Preparation of a Belt Coated Photoreceptor

A belt electrophotographic imaging member is prepared. An imaging member is prepared by providing a 0.02 micrometer thick titanium layer coated on a biaxially oriented polyethylene naphthalate substrate (KALEDEX™ 2000) having a thickness of 3.5 mils, and applying thereon, with a gravure applicator, a solution containing 50 grams 3-amino-propyltriethoxysilane, 41.2 grams water, 15 grams acetic acid, 684.8 grams of 200 proof denatured alcohol and 200 grams heptane. This layer is then dried for about 5 minutes at 135° C. in a forced air drier of the coater. The resulting blocking layer has a dry thickness of 500 Angstroms.

An adhesive layer is then prepared by applying a wet coating over the blocking layer, using a gravure applicator, containing 0.2 percent by weight based on the total weight of the solution of copolyester adhesive (ARDEL D100 available from Toyota Hsutsu Inc.) in a 60:30:10 volume ratio mixture of tetrahydrofuran, monochlorobenzene, methylene chloride. The adhesive layer is then dried for about 5 minutes at 135° C. in the forced air dryer of the coater. The resulting adhesive layer has a dry thickness of 200 Angstroms.

A photogenerating layer dispersion is prepared by introducing 0.45 grams of LUPILON® 200® (PCZ 200) available from Mitsubishi Gas Chemical Corp. and 50 ml of tetrahydrofuran into a 4 oz. glass bottle. To this solution are added 2.4 grams of hydroxygallium phthalocyanine (OHGaPc) and 300 grams of ⅛ inch (3.2 millimeter) diameter stainless steel shot. This mixture is then placed on a ball mill for 20 to 24 hours. Subsequently, 2.25 grams of PCZ 200 is dissolved in 46.1 grn of tetrahydrofuran, and added to this OHGaPc slurry. This slurry is then placed on a shaker for 10 minutes. The resulting slurry is, thereafter, applied to the adhesive interface with a Bird applicator to form a charge generation layer having a wet thickness of 0.25 mil. However, a strip about 10 mm wide along one edge of the substrate web bearing the blocking layer and the adhesive layer is deliberately left uncoated by any of the photogenerating layer material to facilitate adequate electrical contact by the ground strip layer that is applied later. The charge generation layer is dried at 135° C. for 5 minutes in a forced air oven to form a dry charge generation layer having a thickness of 0.4 micrometer.

On the charge generator layer is coated with a transport layer (HTM) containing 50 weight percent (based on the total solids) of a hole transport compound primarily consisting of N,N'-diphenyl-N,N'-bis(3-methyl-phenyl)-(1,1'-biphenyl)-4,4'-diamine. In a one ounce brown bottle, 1.2 grams Makrolon (PC-A from Bayer AG) is placed into 13.5 grams of methylene chloride and stirred with a magnetic bar. After the polymer is completely dissolved, 1.2 grams of N,N'-diphenyl-N,N'-bis(3-methylphenyl)-1,1'-biphenyl-4,4'-diamine is added. The mixture is stirred overnight to assure a complete solution. The solution is applied onto the photogenerator layer made in example 1 using a 4 mil Bird bar to form a coating. The coated device is then heated in a forced hot air oven where the air temperature is elevated from about 40° C. to about 100° C. over a 30 minute period to form a charge transport layer having a dry thickness of 29 micrometers.

Example 5

Preparation of a Belt Coated Photoreceptor With Overcoating Layer

An overcoat layer is coated over the dried charge transporting layer of Example 4. The overcoat layer is applied using a 0.5 mil Bird coating applicator and the solution of Example 1. The overcoat layer is dried at 125° C. for 30 minutes. The dried overcoat layer thickness is about 2.5 micron.

Comparative Example 2

For comparison, a reference belt imaging device is prepared in the same manner of Example 4, i.e., with no overcoat layer.

Following completion of the imaging members, the coating appearance of the imaging members of Example 5 (with overcoating layer) and Comparative Example 2 (without overcoating layer) are observed to be clear with a very uniform appearance. The PIDC and Q-V curves for Example 5 and comparative Example 2 are also obtained and measured. The results are presented in Table 2.

Comparison of the PIDC and Q-V curves for Example 5 and comparative Example 2 show no significant differences. The testing indicates that addition of the overcoating layer does not have any negative effect on the electrical performance of the imaging member. Additionally, after corona exposure, comparative Example 2 shows severe image deletion, which is not evident on the overcoated imaging member from Example 5.

TABLE 2

| Sample | V0 | Vr | Vr 10K cycle-up | Vdepl |
|---|---|---|---|---|
| Example 5 | 800 volts | 41 volts | 14 volts | 26 volts |
| Comparative Example 4 | 800 volts | 57 volts | 35 volts | 17 volts |

The imaging member and control imaging member are also tested for wear in a bench wear fixture with a BCR roll (available from Hodaka) and toners. The overcoated imaging member (Example 5) shows exceptional wear stability, with more uniform wear on the photoreceptor as compared to the control imaging member without the overcoat layer (comparative Example 2).

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An imaging member comprising:

a substrate, a charge generating layer, a charge transport layer, and an external overcoating layer comprising an electron conductive material, wherein said electron conductive material comprises a reaction product of a metal alkoxide and an amine.

2. The imaging member of claim 1, wherein said external overcoating layer comprises said electron conductive material dispersed in a polymeric binder.

3. The imaging member of claim 1, wherein the metal alkoxide is a transition metal alkoxide.

4. The imaging member of claim 1, wherein the metal alkoxide is selected from the group consisting of zirconium alkoxides, titanium alkoxides, zinc alkoxides, hafnium alkoxides, vanadium alkoxides, and mixtures thereof.

5. The imaging member of claim 1, wherein the metal alkoxide is selected from the group consisting of zirconium isopropoxide, titanium (IV) isopropoxide, titanium (IV) methoxide, diisopropoxybisethylacetoacetato titanate, triethanolamine titanate, triethanolamine zirconate, titanium butoxide, titanium diisopropoxide bis(acetylacetonate), titanium diisopropoxide bis(2,2,6,6-tetramethyl-3,5-heptanedionate), titanium (IV) ethoxide, titanium (IV) 2-ethyl-1,3-hexanediolate, titanium (IV) 2-ethylhexoxide, zirconium (IV) tert-butoxide, zirconium (IV) acetylacetonate, zirconium (IV) acetate hydroxide, zirconium (IV) bis(diethyl citrate)dipropoxide, and mixtures thereof.

6. The imaging member of claim 1, wherein the metal alkoxide is titanium (IV) isopropoxide.

7. The imaging member of claim 1, wherein the amine is an aliphatic amine.

8. The imaging member of claim 1, wherein the amine is selected from the group consisting of 3-aminopropyltriethoxysilane, ethanolamine, 3-amino-1,2-propanediol, 3-aminopropyltrimethoxysilane, triethanolamine, Jeffamines (from Huntsman Company), N.N-dimethylaminoethyl methacrylate, and mixtures thereof.

9. The imaging member of claim 1, wherein said metal alkoxide is titanium isopropoxide and said amine is 3-aminopropyltriethoxysilane.

10. A process for forming an imaging member, comprising:

providing an imaging member substrate, and applying at least a charge generating layer and a charge transport layer to said substrate, and applying an electron conductive overcoating layer over said charge generating layer and a charge transport layer, wherein said external overcoating layer comprises an electron conductive material, wherein said electron conductive material comprises a reaction product of a metal alkoxide and an amine.

11. The process of claim 10, wherein said overcoating layer comprises said electron conductive material dispersed in a polymeric binder.

12. The process of claim 10, wherein the metal alkoxide is a transition metal alkoxide.

13. The process of claim 10, wherein the metal alkoxide is selected from the group consisting of zirconium alkoxides, titanium alkoxides, zinc alkoxides, hafnium alkoxides, vanadium alkoxides, and mixtures thereof.

14. The process of claim 10, wherein the metal alkoxide is selected from the group consisting of zirconium isopropoxide, titanium (IV) isopropoxide, titanium (IV) methoxide, diisopropoxybisethylacetoacetato titanate, triethanolamine titanate, triethanolamine zirconate, titanium butoxide, titanium diisopropoxide bis(acetylacetonate), titanium diisopropoxide bis(2,2,6,6-tetramethyl-3,5-heptanedionate), titanium (IV) ethoxide, titanium (IV) 2-ethyl-1,3-hexanediolate, titanium (IV) 2-ethylhexoxide, zirconium (IV) tert-butoxide, zirconium (IV) acetylacetonate, zirconium (IV) acetate hydroxide, zirconium (IV) bis(diethyl citrate) dipropoxide, and mixtures thereof.

15. The process of claim 10, wherein the metal alkoxide is titanium (IV) isopropoxide.

16. The process of claim 10, wherein the amine is an aliphatic amine.

17. The process of claim 11, wherein the amine is selected from the group consisting of 3-aminopropyltriethoxysilane, ethanolamine, 3-amino-1,2-propanediol, 3-aminopropyltrimethoxysilane, triethanolamine, Methoxypoly[oxyethylene/oxypropylene]2-propylamine, polyoxyalkyleneamines, N,N-dimethylaminoethyl methacrylate, and mixtures thereof.

18. An electrographic image development device, comprising the imaging member of claim 1.

* * * * *